US008480097B1

(12) United States Patent
Judge et al.

(10) Patent No.: US 8,480,097 B1
(45) Date of Patent: Jul. 9, 2013

(54) CREEPER

(75) Inventors: John Farley Judge, Milwaukie, OR (US); Charles H. Lewis, Lincoln City, OR (US)

(73) Assignee: Cloud Cap Innovations LLC, Portland, OR (US)

( * ) Notice: Subject to any disclaimer, the term of this patent is extended or adjusted under 35 U.S.C. 154(b) by 0 days.

(21) Appl. No.: 13/423,062

(22) Filed: Mar. 16, 2012

(51) Int. Cl.
*B25H 5/00* (2006.01)
*A62B 9/04* (2006.01)
*A61G 1/003* (2006.01)

(52) U.S. Cl.
USPC ..... 280/32.6; 280/18; 5/81.1 C

(58) Field of Classification Search
USPC ..... 280/32.6, 18, 845; 428/178, 182, 428/212, 73, 75–76, 155; 5/81.1 C, 81.1 HS, 5/81.1 R, 81.1 T, 417; 195/238; 184/106
See application file for complete search history.

(56) References Cited

U.S. PATENT DOCUMENTS 5,005,232 A 4/1991 Wright et al.
5,419,945 A * 5/1995 Lopez ..... 428/178
5,966,754 A * 10/1999 Schuster ..... 5/81.1 R
6,675,411 B1 * 1/2004 Javier ..... 5/81.1 HS
7,650,654 B2 * 1/2010 Lambarth et al. ..... 5/81.1 HS
2005/0102750 A1 * 5/2005 Berge ..... 5/81.1 HS
2008/0216231 A1 * 9/2008 Lambarth et al. ..... 5/81.1 HS
2011/0061162 A1 * 3/2011 Judge ..... 5/81.1 R

OTHER PUBLICATIONS http://www.sandelmedicalcom/Z-Slider-Patient-Transfer-Sheet.asp Publisher: Sandel, LLC; Title: Z-Slider(TM) Patient Transfer Sheet; Date of Publication: Unknown; Place of Publication: Internet; relevant pages: page at link indicated above, which includes links to "Request Product Literature" and "Watch a Demonstration Video."

* cited by examiner

*Primary Examiner* — John Walters
*Assistant Examiner* — James Triggs
(74) *Attorney, Agent, or Firm* — Portland Intellectual Property, LLC

(57) ABSTRACT

A creeper is formed of a sheet-like material in a tubular configuration, wherein the material is formed of one or more layers joined to one another. The creeper has an inner side defining a coefficient of friction of not more than about 0.35. The material in bulk falls within an acceptable range of specified flexural rigidity, crease resistance and/or puncture resistance.

20 Claims, 7 Drawing Sheets

| Sample Description | Flexural Rigidity (mg-cm) | Crease Recovery (degrees) | Resilience (percent) | Puncture Resistance (lbs) |
|---|---|---|---|---|
| Material Description: Multi-layer, quilted construction<br>L1: Cotton Fabric, .25mm<br>L2: Polyester Batting, 6.35mm thick<br>L3: Cotton Fabric, .25mm<br>Sample Size: 25mmx203.2mm, Sample weight: 1.9g | 2,606 | 138 | 7 | 22 |
| Material Description: Multi-layer, quilted construction<br>L1: Polypropylene non-woven fabric<br>L2: Cotton fiber filler, 6.35mm thick<br>L3: Polypropylene non-woven fabric<br>Sample size: 25mmx203.2mm, Sample weight: 3.8g | 11,812 | 139 | 20 | 22 |
| Material Description: Multi-layer, bonded contruction<br>L1: Polyester, doesuede fabric, .76mm thick<br>L2: Polyester open cell foam, 1.77mm thick<br>Sample size: 25mmx203.2mm, Sample weight: .9g | 2,682 | 164 | 5 | 14 |
| Material Description: Single layer<br>L1: Polyethylene, cross linked closed cell foam, 6.35mm thick<br>Sample size: 25mmx203.2mm, Sample weight: 2.2g | 821,539 | 175 | 31 | 11 |
| Material Description: Single layer<br>L1: EVA, closed cell foam, 3.17mm thick<br>Sample size: 25mmx203.2mm, Sample weight: .5g | 22,689 | 177 | 28 | 2 |
| Material Description: Single layer<br>L1: Rubber sheet made from recycle rubber granulates binded together with urethane, 3.17mm thick<br>Sample size: 25mmx203.2mm, Sample weight: 13.6g | 86,454 | 172 | 24 | 18 |
| Material Description: Single layer<br>L1: Neoprene sheet, 1.78mm thick<br>Sample size: 25mmx203.2mm, Sample weight: 12.6g | 70,032 | 172 | 7 | 26 |
| Material Description: Single layer<br>L1: Polyurethane, open cell foam, 12.7mm thick<br>Sample size: 25mmx203.2mm, Sample weight: 1.2g | 50,298 | 175 | 16 | 4 |
| Material Description: Multi-layer, bonded construction<br>L1: Polyester fabric, .35mm thick<br>L2: Styrene butadiene rubber foam, 3.17mm thick<br>L3: Polyester fabric, .35mm thick<br>Sample size: 25mmx203.2mm, Sample weight: 3.4g | 8,114 | 165 | 23 | 25 |
| Material Description: Multi-layer, bonded construction<br>L1: Nylon fabric, .24mm thick<br>L2: Polyurethane open celled foam, 4.5mm thick<br>L3: Nylon fabric, .11mm thick<br>Sample size: 25mmx203.2mm, Sample weight: 1.8g | 25,011 | 176 | 7 | 63 |

Fig. 12

CREEPER

FIELD OF THE INVENTION

The present invention relates to creeper, such as a mechanic's creeper.

BACKGROUND

The mechanic's creeper, also known simply as a creeper, is traditionally a low, wheeled platform for supporting a person in a supine position underneath an apparatus, usually an automobile which is supported above a concrete garage floor by a jack or by jack-stands, on which the person is effectuating repair or performing other work. Creepers are virtually indispensable for those who routinely perform such work and do not have a hydraulic or screw-type lift for lifting the apparatus sufficiently high above the floor of the work area to allow the person to stand erect underneath the apparatus.

Creepers are not insignificantly complex. The platform is formed primarily of a rigid planar sheet, typically of wood, which is usually mounted to and supported by a metal frame. Very narrow and low profile wooden side rails are typically attached to the platform to give the user tactile feedback helpful for the user to remain centered on the platform. The frame, or the platform if there is no frame, is supported at four corners by four independently mounted wheels or casters. The wheels or casters are typically formed of metal or hard plastic and have narrow tracks to decrease rolling resistance. Each wheel or caster is supported by a short metal axle that is rotatably mounted to the frame, or to the underside of the platform if there is no frame, so that the axle can be rotated more than 360 degrees about an associated axis that is perpendicular to the plane of the platform.

So that the platform of the creeper can be held close to the floor and to maintain a low profile for the creeper, the wheels or casters are of small diameter, typically about 2-3". But small diameter wheels/casters are more easily jammed or blocked by small irregularities on the surface of the floor, and so it is a significant limitation of creeper design that the creeper must be used on a floor surface that is hard, smooth, and substantially free of debris to function properly.

Also, to avoid undesirable interference between the user's back, arms or legs and the wheels, the creeper platform is typically at an elevation above the floor that is at least equal to the wheel/caster diameter. Thus it is another significant limitation of creeper design that increasing the diameter of the wheels/casters to reduce the creeper's sensitivity to irregularities in the floor surface necessarily increases the amount of clearance that must be provided underneath the apparatus.

There have been attempts to solve the problem of excess creeper height. That described in U.S. Pat. No. 5,330,209 is representative of the traditional approach. It requires a more elaborate frame and therefore additional cost, and it results in a greater interference with the user's arms.

An alternative approach to solving the height problem known in the art is the "Hover Creeper" which requires a smooth surface and a source of compressed air.

It is both an advantage and a disadvantage that the traditional mechanic's creeper is supported by wheels or casters so that it can be easily moved. For example, a mechanic positioning a creeper in a desired position underneath a vehicle and using a wrench to loosen a bolt exerts a force on the bolt that, if not resisted by the creeper, will cause the creeper to move away from the desired position. The solutions to this problem also typically involve significantly increased cost and weight, in the form of added braking mechanisms that can be set by the user at the desired position. An example is described in U.S. Pat. No. 7,032,909.

The present invention eliminates the aforedescribed limitations of creeper design, and provides for the lowest possible profile along with significant savings in cost and weight.

SUMMARY

A creeper is disclosed herein. The creeper is formed of a sheet-like material in a tubular configuration, wherein the material is formed of one or more layers joined to one another. The creeper has an inner side surface defining a coefficient of friction of not more than about 0.35.

Preferably, the creeper has at least one other material specification, taken from among the following, in any combination:

1) The material in bulk falls within an acceptable range of specified flexural rigidity.
2) The material in bulk has a minimum crease recovery.
3) The material in bulk falls within an acceptable range of resilience.
4) The material in bulk has a minimum puncture resistance.

Preferably, in combination with any of the above material specifications, the material allows for a maximum permissible degree of water penetration, and/or a minimum permissible oil repellancy grade.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

BRIEF DESCRIPTION OF THE DRAWINGS

FIG. 12 is a chart of examples of creeper materials and corresponding results for Tests A-D.

DETAILED DESCRIPTION OF PREFERRED EMBODIMENTS

Figure 1:
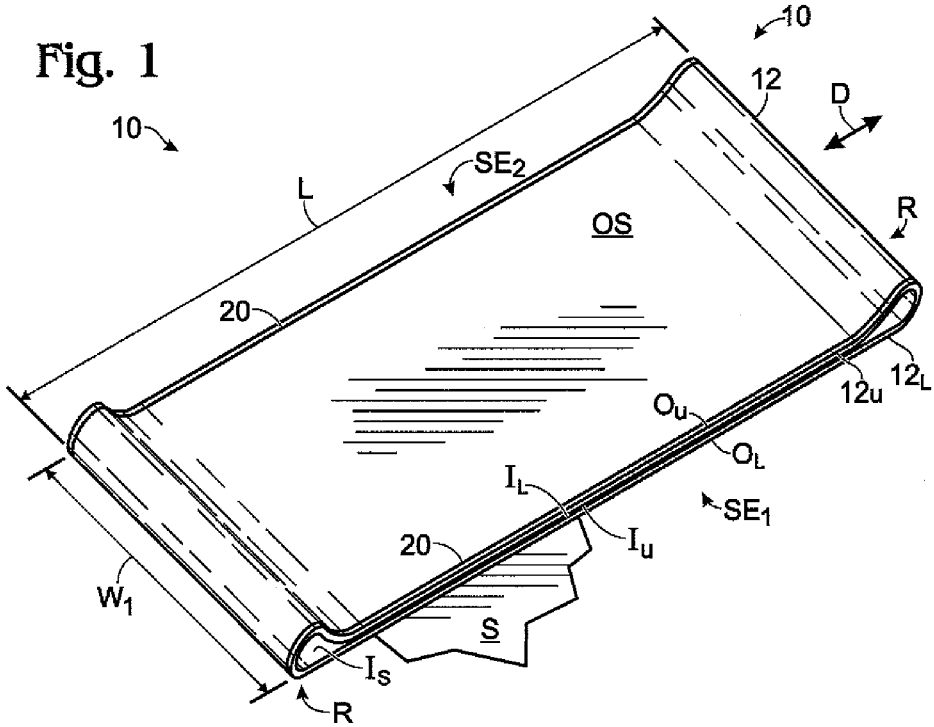
FIG. 1 is an isometric view of a creeper 10 according to the present invention.

FIG. 1 shows a creeper 10 according to the present invention. As is apparent, the creeper 10 has an architecture unlike that of the traditional mechanic's creeper. There are no wheels and there is no platform; rather, the creeper 10 incorporates a thin sheet-like material 12 configured as a tube that is collapsed upon itself to define two semi-independent layers, namely an upper layer $\mathbf{12}_U$ and a lower layer $\mathbf{12}_L$. The tube is open at each side (side ends "SE," namely $SE_1$ and $SE_2$). The layers $\mathbf{12}_U$ and $\mathbf{12}_L$ are able to slide relative to one another, one on top of the other in either of the directions indicated as "D," thus allowing the creeper 10 to translate in these directions in the manner of what is commonly known as a "Caterpillar™ track." This function is also the same as that provided by use of devices known in the medical care arts as patient transfer tubes, such as disclosed in Javier, U.S. Pat. No. 6,675,411.

Figure 2:
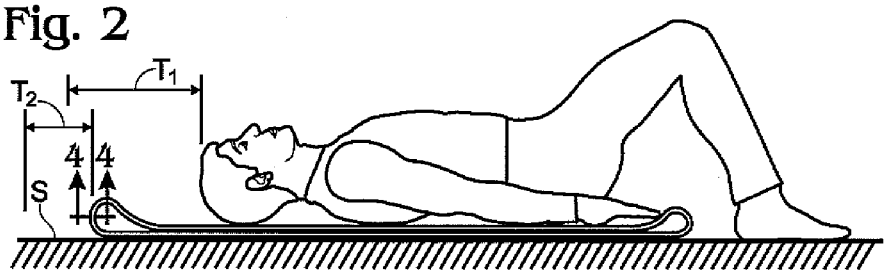
FIG. 2 is an elevation view of the creeper of FIG. 1 in use by a user, showing the user's preparation for propelling the creeper forward.
Figure 3:
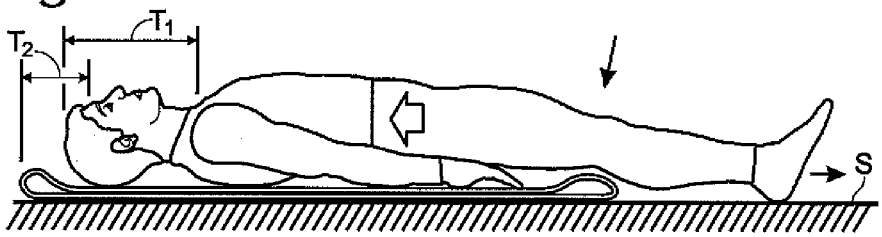
FIG. 3 is an elevation view of the creeper of FIG. 1 in use by a user, showing the user propelled forward relative to the position shown in FIG. 2.

More particularly, the upper layer $\mathbf{12}_U$ defines an outermost surface "$O_U$" and an innermost surface "$I_U$," and the lower layer $\mathbf{12}_L$ defines an outermost surface "$O_L$" and an innermost surface "$I_L$." Referring to FIGS. 2 and 3, the creeper 10 is deployed so that the outermost surface $O_L$ is disposed on a supporting surface S, such as a garage floor. The user lies, ordinarily face up, on top of the outermost surface $O_U$. The innermost surfaces $I_U$ and $I_L$ are in intimate contact with each other. The user propels him or herself in one of the directions D by use of arms or legs acting on the surface S, causing the innermost surface $I_U$ to slide on the innermost surface $I_L$ in the selected direction D. FIGS. 2 and 3 illustrate this "creeper" action. FIGS. 2 and 3 are vertically aligned to show the movement of the creeper 10. By comparing the two Figures, it can be appreciated that the creeper will travel at ½ the amount, and therefore at ½ the speed, that the user travels.

To a limited extent, the layers $\mathbf{12}_U$ and $\mathbf{12}_L$ can also slide laterally relative to each other, and/or twist relative to each other. These additional movements provide the user additional freedom to adjust his her position or orientation.

While four surfaces have been identified to describe the action of the creeper 10, in fact it has only two surfaces (or sides), namely an outer surface OS and an inner surface IS. Thus the material 12 may be initially provided as a flat sheet; and thereafter two opposite ends may be joined to one another, such as by heat welding or fusion, to form the tubular creeper configuration. The material 12 may also be integrally formed in a tubular configuration, such as by blow molding or blown film extrusion.

For purposes herein, the term "tubular configuration" is defined to mean a configuration of sheet-like material having a length dimension, a width dimension, and a thickness dimension, where both the length and width dimensions are at least ten times greater than the thickness dimension, the material having two opposite side surfaces defined by the length and width dimensions that join one another across the width dimension to define, respectively, the interior and exterior of a tube, where the tube is open at two opposite ends (e.g., $SE_1$ and $SE_2$ in FIG. 1) over at least 80% of the length dimension, and where the interior surface of the tube is free to slide upon itself along the length dimension.

Figure 4:
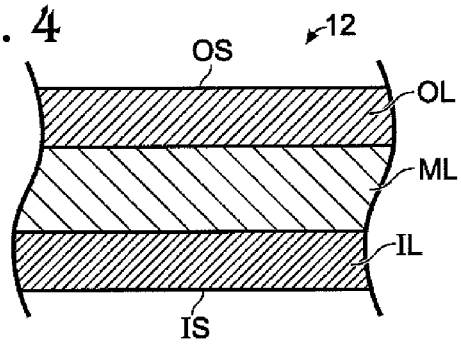
FIG. 4 is a cross-section of a cut-away portion of the material of which the creeper 10 of FIG. 1 is formed.

FIG. 4 shows a cross-section of the material 12. In the preferred embodiment shown, the material 12 has three layers "XL" as follows: (1) an outermost layer OL that defines the outer surface OS; (2) an innermost layer IL that defines the inner surface IS; and (3) a middle layer ML disposed between the layers OL and IL. The terms "outermost" and "innermost," as opposed to "outer" and "inner," are intended to allow for the possibility that there are more than three layers.

In contrast to the earlier described upper and lower layers $\mathbf{12}_U$ and $\mathbf{12}_L$ of the creeper 10, the layers XL of the material 12 are physically connected to one another. They may be homogeneous layers joined together in any desired manner, such as by being stitched, glued, heat welded, or laminated. Alternatively, any two or more adjacent layers can be formed or incorporated together as an integral, heterogeneous layer. Other alternatives may be possible; the distinction between one XL layer and another is intended to be functional rather than structural.

The outermost layer OL forms the outermost surface OS of the creeper. It is intended to function as a "protective" layer. It may accomplish this function either by repelling water or oil, or by allowing the absorption of water or oil into deeper layers where it is kept away from the user. But while the protective function is desirable, it should be understood that it is not essential, because it will not necessarily be the case that the creeper will be used in either a wet or oily environment.

The middle layer ML is intended to function as a "comfort" layer for cushioning the user from irregularities in or on the surface S. For example, if the surface S is an otherwise smooth garage floor, it may nevertheless have disposed on its surface small hardware bits such as screws or nails, or small rock chips. As another example, the surface S may be outdoors, and be formed of relatively irregularly surfaced asphalt, gravel or dirt. But while the comfort function is highly desirable, it should be understood that it is not essential, because it will not necessarily be the case that the creeper will be used on a support surface S that is not smooth and free of debris.

The innermost layer forms the innermost surface IS. The function here is to minimize the coefficient of friction implicated in the sliding action. The coefficient of friction between two innermost surfaces IS must be less than that defined between the outermost surface OS and the support surface S, so that the inner surfaces will slide on each other in preference to the lower layer $\mathbf{12}_L$ sliding on the surface S. However, since the surface S will generally have a high coefficient of friction relative to any of the surfaces of the creeper 10, there will generally be no need for concern about the coefficient of friction of the outer surface OS unless the supporting surface S is unusually slippery. As a general rule, the coefficient of friction of the innermost surface IS is preferably less than that of the outermost surface OS, and it is most preferably at least 50% less.

While the three functions described above are in many cases best achieved by use of a material 12 incorporating three separate layers formed of three separate materials, the creeper need not have any particular number of layers or incorporate different materials to realize them. A homogeneous single layer of material may provide all three functions.

The inventors have also discovered that the capability of the material 12 to function as a creeper is critically influenced by two competing bulk material properties, flexural rigidity and crease recovery. The material should be rigid enough to avoid buckling, but it should also be capable of turning the corners indicated as "R" in FIG. 1 and recovering to an essentially planar configuration very soon thereafter.

To relate the aforementioned features of the invention to testable aspects of the material 12, the inventors have determined that the following tests and test results are sufficient to define a material 12 that is satisfactory for use as a creeper according to the invention.

First, the innermost surface IS of the material preferably has a coefficient of friction, sliding upon itself (corresponding to the innermost surface $I_U$ sliding on the innermost surface $I_L$), that is no greater than about 0.35, but preferably, it is less than 0.30, more preferably it is less than 0.20, and most preferably it is less than 0.10.

Second, the material in bulk preferably has a flexural rigidity, measured according to the ASTM (American Society for Testing and Materials) International standard, Designation: D 1388-96, of between about 2,000 and 500,000 mg-cm. More preferably, the upper limit is about 100,000 mg-cm, and most preferably, it is about 50,000 mg-cm. This is to ensure that the material maintains the rolled configuration at the ends of the creeper shown in FIG. 1 referenced as "R," particularly at the end of the creeper 10 that is in the direction D of travel of the creeper.

Third, the material in bulk preferably has a "crease recovery," measured according to British Standard BS EN 22313: 1992 (ISO 2313: 1972), of more than about 100 degrees. This is to ensure that the material recovers sufficiently from any buckling that may occur in the material as the upper layer $\mathbf{12}_U$ is pushed forward or laterally skewed by the user.

Preferably, to provide the desired comfort function, the material in bulk also has a resilience, measured according to the ASTM International standard, Designation: D 3574-05 with a modification as described below, of between about 5 and 40 percent. Most preferably the upper limit is about 30%, and most preferably it is about 25%.

Preferably, the material in bulk also has a puncture resistance, measured according to the ASTM International standard, Designation: D751-06 ("Puncture Resistance"), of at least 10 pounds, more preferably at least 20 pounds, and most preferably at least 40 pounds.

FIG. 12 is a chart of examples of materials and values of flexural rigidity, crease recovery, resilience, and puncture resistance measured for those materials by the present inventors. All of the examples have three or fewer layers. Where there are three layers, the notations "L1," "L2," and "L3" refer, respectively, to an outer layer, a middle layer, an inner layer; where there are only two layers, the notations "L1" and "L2" refer, respectively, to an outer layer and an inner layer; and where there is just one layer, the notation "L1" refers to that layer.

The fourth example is being included to provide an example of a material that was deemed to be unsatisfactory, in this case due to having a flexural rigidity that is too high.

Preferably, to provide the desired water resistance function, the material should have a water penetration, measured according to the AATCC (American Association of Textile Chemists and Colorists) "Test Method 42-2007", of 5 grams or less.

Preferably, to provide the desired oil resistance function, the material should have an oil repellency grade, measured according to the AATCC "Test Method 118-2007", of at least 2.

Both the desired water resistance and oil repellancy are preferably provided by use of a single coating of polyurethane defining the outermost layer OL of the creeper 10, and therefore the outermost surface OS. Other preferred coating materials are rubber, silicone rubber, polyvinylchloride (PVC), polytetrafluorethylene (PTFE), and polychoroprene (neoprene). Other coating material alternatives, and methods of application thereof, are described in Handbook of Technical Textiles, CRC Press LLC, 2000 Corporate Blvd., NW Boca Raton Fla., 33431, USA (ISBN 0-8493-1047-4), Chapter 8, "Coating of technical textiles," by Michael E. Hall, the entirety of which is incorporated by reference herein.

To summarize relevant information provided in the Handbook, the aforementioned coatings are thermoplastic, linear polymers which can be applied in the form of a viscous liquid spread on the surface of the material. The liquid is dried or cured, or cross-linked, to form a solid coating. Some exemplary coating techniques are "lick roll," in which the material is passed over a roller which rotates in a trough of liquid coating material; "knife coating," in which the liquid coating material is spread uniformly over the material by use of a knife; "hot melt coating," in which the liquid coating material is calendered or extruded directly onto the material; and "transfer coating," in which the coating material is pre-hardened in the form of a continuous sheet which is laminated to the material either by the application of heat or by use of an adhesive.

ASTM International standard, Designation: D 1388-96, and ASTM International standard, Designation: D 3574-05, and ASTM International standard, Designation: D751-06 are available from ASTM International, 100 Barr Harbor Drive, PO Box C700, West Conshohocken, Pa., 19428-2959, USA. British Standard BS EN 22313: 1992 (ISO 2313: 1972) is available from the European Committee for Standardization, Central Secretariat: rue de Stassart 36, B-1050 Brussels, BELGIUM. AATCC Test Method 42-2007, and AATCC Test Method 118-2007, are available from AATC, P.O. Box 12215, Research Triangle Park, N.C. 27709-2215, USA. All of these standards are incorporated by reference herein in their entireties.

All of these standards are copyright protected and none are available for reproduction without a license. Therefore, the inventors have also provided working descriptions of these standards as they apply to defining the invention below.

The term "Test A" is defined to mean the testing methodology described under the heading "Test A" below or, equivalently, ASTM International standard, Designation: D 1388-96; the term "Test B" is defined to mean the testing methodology described under the heading "Test B" below or, equivalently, British Standard BS EN 22313: 1992 (ISO 2313: 1972); the term "Test C" is defined to mean the testing methodology described under the heading "Test C" below or, equivalently, ASTM International standard, Designation: D 3574-05 modified as described under the heading "Test C" below; the term "Test D" is defined to mean the testing methodology described under the heading "Test D" below or, equivalently, ASTM International standard, Designation: D751-06; the term "Test E" is defined to mean the testing methodology described under the heading "Test E" below or, equivalently, AATCC Test Method 42-2007; and the term "Test F" is defined to mean the testing methodology described under the heading "Test F" below or, equivalently. AATCC Test Method 118-2007.

Except with regard to Test C, if there is a conflict between a Test performed according to the standard as published by the responsible entity and the same Test performed according to the description below, satisfaction of either shall be considered sufficient for purposes herein. With regard to Test C, if there is a conflict between the test apparatus or method for performing Test C according to ASTM International standard, Designation: D 3574-05 (Test C) and the test apparatus or method for performing Test C as described below, except with regard to the modification indicated, satisfaction of either shall be considered sufficient for purposes herein. However, Test measurements must be made with the modification in place; any measurements made according to ASTM International standard, Designation: D 3574-05 (Test C) without the modification will not be comparable.

The creeper 12 has a limited range of travel before a person using it would be required to reposition him or herself thereon. Referring to FIGS. 2 and 3, "$T_1$" represents the distance traveled by the user, relative to the surface S. $T_1$ as shown is conveniently measured from a point at the top of the user's head in FIG. 2 to the same point in FIG. 3, but any other point could be used for this measurement. Similarly, "$T_2$" represents the distance traveled by the creeper, relative to the surface S. $T_2$ as shown is conveniently measured from a point at the leading edge of the creeper in FIG. 2 to the same point in FIG. 3, but any other point could be used for this measurement. It is a defining characteristic of the creeper that $T_2$ is ½ $T_1$.

As can be appreciated from FIGS. 2 and 2, the length "L" (FIG. 1) of the creeper is preferably sufficient to accept the full length of the person measured from the user's outstretched fingertips as shown in FIG. 2 to the top of the user's head, plus an amount equal to $T_2$=one-half the desired travel $T_1$. The present inventors have determined that a preferred range for L is between about 54" to 66" when the creeper 10 is used as a creeper. Correspondingly, the width "$W_1$" is preferably about 18"-36"; and more preferably, it is about 24"-32".

Returning to FIG. 1, in a preferred embodiment of the creeper the length "L" is about 60" measured with the creeper flattened, corresponding to a 120" circumference, with the width $W_1$ being about 28". There is a binding or hem material 20 that is used to wrap around each of two side edges SE, namely "$SE_1$" and "$SE_2$" of the creeper 10.

A preferred material 12 for the creeper 10 has three layers, an outer layer OL formed of woven or non-woven nylon, polyester, or polyester/cotton blend cloth or fabric; a middle layer ML that is ¼" to ½" thick formed of either recycled cotton with a density of 1-2 lbs/square yard, or polyester batting with a density of 200-300 gm/square meter; and an inner layer IL formed of a woven nylon cloth or fabric which is coated with silicone to lower the coefficient of friction.

It is preferred to quilt or stitch the outer and middle layers together, but not to quilt or stitch the IL layer to the other layers but to attach the IL layer via the aforementioned binding material. The binding material is preferably a woven polyester or nylon, preferably 2" wide for extending inwardly from each side edge SE a distance "$D_2$" of about 1".

Another preferred material 12 has three layers, an outer layer OL formed of a woven 600 denier nylon cloth or fabric; a middle layer ML formed of styrene butadiene rubber foam having a thickness in the range of 0.03-0.12"; and an inner layer IL formed of a woven 100 denier nylon cloth or fabric which is coated with silicone to lower the coefficient of friction. The three layers are attached together with an adhesive. A spray-on adhesive, such as that marketed by the 3M Company of St. Paul, Minn. as 3M® Super 77® Multipurpose Adhesive, is particularly convenient for this purpose.

In both of its preferred forms, the material 12 is preferably double stitched at ends "E" to form the tubular configuration, which will result in a seam 22. In both cases a coating is applied to the material as described above.

It should be appreciated that a creeper according to the present invention could be used for translating any object for any purpose, and it is therefore not limited to being used for moving a person for the purpose of allowing the person to work underneath an apparatus. For example, the creeper 10 could be used for moving a non-ambulatory person from a table or gurney to a bed (or vice versa), or it could be used for moving furniture, either in or outside a building. In this latter regard particularly, it may be noted that two creepers could be used in series to infinitely extend the range of travel. That is, two creepers A and B may be arranged with creeper B forward of creeper A, so that an object being moved in the forward direction will pass from creeper A onto creeper B. When the object has moved far enough to have left creeper A and becomes fully supported by creeper B, creeper A can be picked up and placed ahead of creeper B to repeat the process. In general, the length L of the creeper should be at least twice the length of the object being moved.

Some other possible uses of the creeper are, in a larger size, to transfer gravel, dirt, or bark dust from a pick-up bed, to transfer the root ball of a tree into a hole, to transfer dirt dug from the hole back into the hole, and to transfer a carcass from the tail-gate of a pick-up into the bed.

FIGS. 13-16 show use of the creeper 10 for transferring a load of particulate matter 50 such as gravel, dirt, or bark dust from, e.g., the bed 52 of a pick-up truck 54. The bed 52 could alternatively be part of a utility trailer, or it could represent a loading dock from which the particulate matter 50 is loaded into a pick-up bed or utility trailer, or it could represent any other desired surface on which the particulate matter is stored, held or staged.

It is desired to move the particulate matter 50 out of the bed 52, and this is greatly facilitated by sliding it on the creeper.

Figure 14:
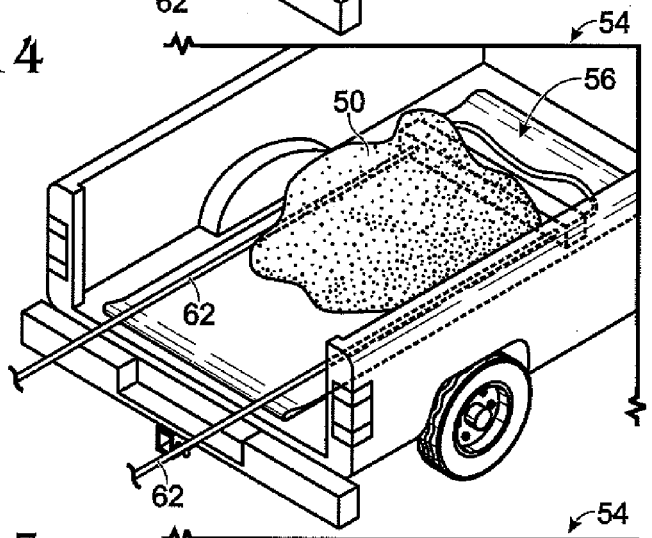
FIG. 14 is an isometric view of the creeper, harness, and pick-up truck of FIG. 13, with a load of particulate matter disposed on the creeper.

A person can stand in the bed 52, behind the particulate matter, at the location referenced as 56 in FIG. 14, and push on it with a broad-faced implement, such as a hoe or gravel rake, to cause the creeper to move, but this is often awkward.

According to the present invention, preferably, a harness 60 is provided that allows one or more users to pull on the particulate matter. The harness 60 in a preferred embodiment includes a strap or rope 62 that is threaded through a pulling element 64, which may be for example a 3 foot length of 2×4 lumber with the "4" dimension oriented vertically. An elongate flexible member 62 such as a rope, strap or chain is attached to the pulling element 64. In the embodiment shown, a single length of the member 62 is fed through two holes at opposite ends of the pulling element 64, the rope extending forward through one of the holes, running behind the element 64, and back through the other of the holes. The flexible member 62 could alternatively be attached substantially centrally to the pulling element 64, with the flexible member terminating at the pulling element. Other configurations are possible, and there may be any number of flexible members.

The flexible member(s) 62 may but need not be disposed underneath the particulate matter (the load), and they may, but need not be disposed on the outer surface OS of the creeper. The pulling element 64 also may but need not be disposed on the outer surface OS of the creeper. Further, the pulling element 64 need not be rigid and the flexible member(s) 62 need not be flexible.

Figure 15:
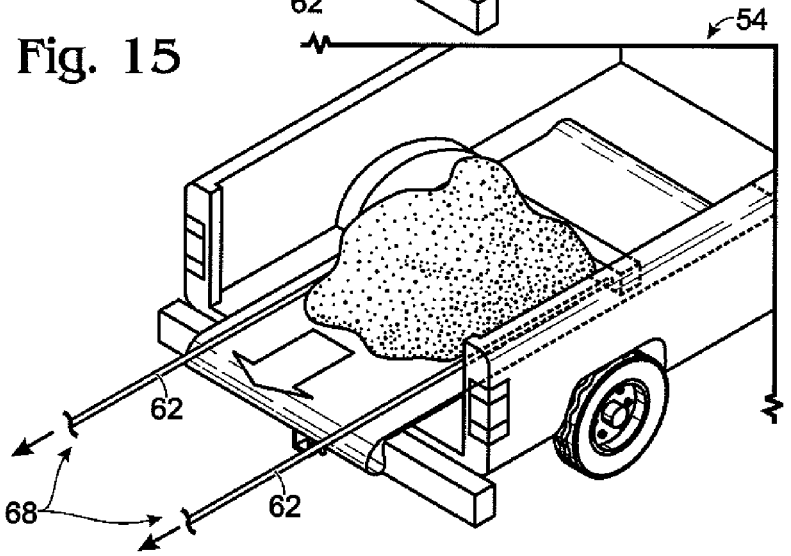
FIG. 15 is an isometric view of the creeper, harness, pick-up truck, and load of particulate matter of FIG. 14 showing the load in the process of being unloaded by use of the creeper and harness.

FIG. 15 shows the result of pulling on the flexible member 62, which is to cause the pulling element 64 to make contact with the dirt and pull on it, causing the creeper to translate. The inventors have found that the surface area "SA" of the pulling element 64 that makes contact with the dirt need not be very great, due to the exceptional ease with which the creeper can be caused to translate.

The flexible member(s) can be attached, permanently or removably in any manner known in the art, to the upper layer of the creeper (at any location(s) thereon, but preferably in the region indicated generally as 56, behind the load), instead of to a pulling element like the pulling element 64, so that the surface of the creeper is being pulled rather than a pulling element disconnected therefrom, but it is believed to be an advantage of the creeper that this is not essential. That is, it is believed to be an advantage that the harness 60 allows for moving a load disposed on the creeper by pulling on the load rather than by pulling on the creeper.

Depending on the heaviness of the load and the area over which the force it exerts is distributed, the material may require additional puncture resistance.

The ends (or end) 68 of the flexible member 62 can be pulled on directly by the user, or they can be anchored to the ground, or to a tree, and the truck 54 driven forward, or where there are two (or more) ends as shown, the ends can be attached to a cross-member or other support element and the cross-member or other support element can be pulled, or anchored.

The creeper 10 automatically provides the braking function noted previously as being desired in the prior art and "solved" by the addition of braking mechanisms. The creeper functions by providing two surfaces that slide on each other, as governed by both a static and dynamic coefficient of friction. The difference between static and dynamic coefficients of friction provides for what is known as the "stick-slip" or "slip-stick" phenomenon, by which coming to rest increases the coefficient of friction. The unique construction of the creeper takes advantage of this phenomenon; the creeper is able to "slip" to a desired location and, once brought to rest, the creeper tends to "stick" in place.

Test A

Figure 5:
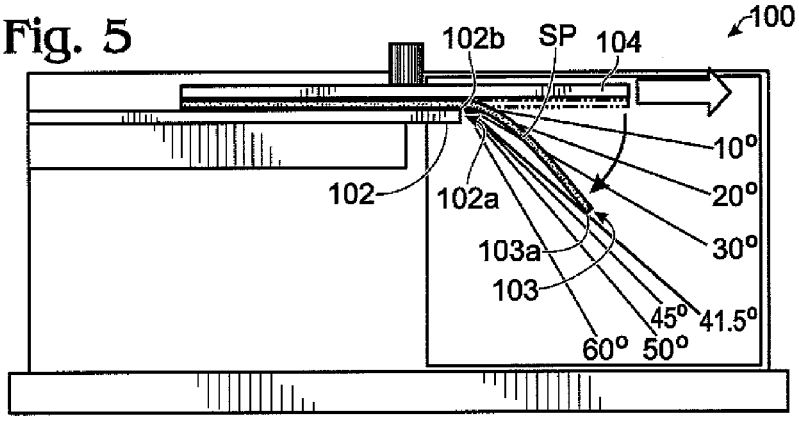
FIG. 5 is an elevation view of an apparatus for measuring a flexural rigidity of the material of which the creeper of FIG. 1 is formed according to Test A as defined herein.

Flexural rigidity of the material 12 according to Test A is measured with the apparatus 100 shown in FIG. 5. A rectangular test specimen S is cut from a larger piece of the material so that it has dimensions of 25+/−1 mm (width) by 200 mm+/−1 mm (length). The apparatus supports a horizontally disposed platform 102 for receiving the specimen, arranged on the platform so that its length dimension extends in the direction of the arrow. A "movable slide" 104 is provided to lie on top of the specimen to maintain its flatness. The slide 104 is a metal bar at least 25 mm (width) by 200 mm (width) by approximately 3 mm (thickness), and having a mass of 270 g+/−5 g.

A user of the apparatus feeds the specimen manually by sliding the slide 104 in the direction of the arrow at a rate of 20+/−1 mm/second. As a result, an end 103 of the specimen is caused to extend by increasing amounts beyond an end 102*a* of the platform.

The user continues to feed the specimen until the bottom of the end 103 of the specimen (a point referenced as 103*a*) reaches a line drawn from the top of the end 102*a* of the platform (a point referenced as 102*b*) at a negative 41.5 degrees, whereupon feeding is immediately stopped. The length of specimen extending beyond the end 102*a* of the platform 102 is the "bending length" of the specimen for use in a formula for computing flexural rigidity as follows:

$$[\text{Flexural rigidity(mg-cm)}]=[(\text{material mass per unit area(mg/cm}^3))\times(\text{bending length (cm)})^3]$$

Results for 3 specimens are obtained and averaged.

Test B

Figure 6:
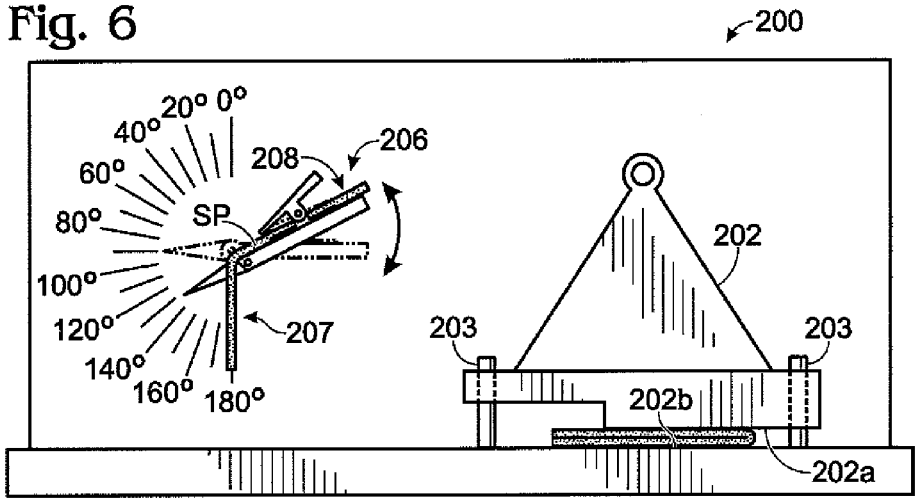
FIG. 6 is an elevation view of an apparatus for measuring a crease recovery of the material of which the creeper of FIG. 1 is formed according to Test B as defined herein.

Crease recovery of the material 12 according to Test B is measured with the apparatus 200 shown in FIG. 6. A rectangular test specimen S is cut from a larger piece of the material so that it has dimensions of 15 mm (width) by 40 mm (length). The specimen should be conditioned at least 24 hours at 20+/−2 degrees Celsius and 65+/−2% relative humidity.

By use of a pair of tweezers, gripping the specimen no further than 5 mm from its ends, the specimen is folded in its lengthwise dimension, in half, and placed in a press 202. The press 202 has a pressing portion 202*a*, a specimen supporting portion 202*b*, and vertical guides 203 slidably extending through the pressing portion 202*a* and anchored relative to the specimen supporting portion, for laterally constraining the pressing portion relative to the specimen supporting portion.

The pressing portion applies a load of 10 Newtons (2.248 pounds) at the folded end of the specimen, over an area of the specimen that is 15 mm×15 mm. The specimen is pressed for 5 min+/−5 seconds. At the end of this time, the load is removed "quickly but smoothly so that the specimen does not suddenly spring open," in less than 1 second.

The specimen, as folded and only partially recovered defines a crease, and two legs on either side of the crease. A first one of the legs is held between the flat of the tweezers, and the second leg is "gently introduce[d]" between two parts of a clamp 206 for clamping the second leg (referenced as 208) therebetween. The crease is left outside the clamp 206 so as "not to disturb" it, and the first leg (referenced as 207) is also left outside the clamp 206 so that it hangs downwardly.

The clamp is mounted to the apparatus so that the angle of the clamp 206 can be varied. 5 minutes after removal of the load, the clamp angle is continuously increased until the first leg can no longer maintain a vertical orientation. For reference, the angle shown in FIG. 6 where this occurs is about 130 degrees. Zero degrees corresponds to no recovery, and 180 degrees corresponds to full recovery.

Results for 3 specimens are obtained and averaged.

Test C

Figure 7:
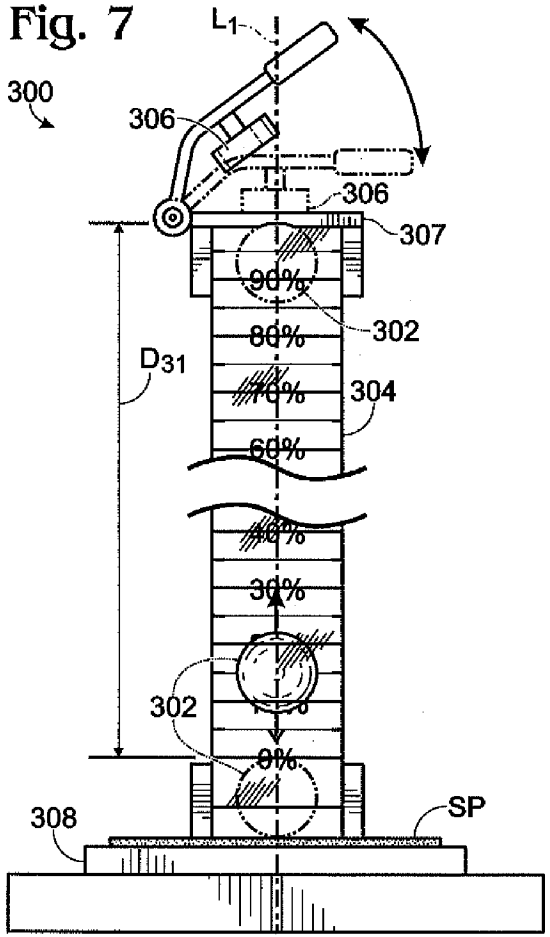
FIG. 7 is an elevation view of an apparatus for measuring resilience of the material of which the creeper of FIG. 1 is formed according to a Test C as defined herein.

Resilience of the material 12 according to Test C is measured with the apparatus 300 shown in FIG. 7. A steel ball 302 having a diameter of 16.03+/−0.2 mm diameter is dropped along the cylindrical axis "$L_1$" of a vertically oriented clear plastic cylindrical tube 304, such as may be formed of acrylic, having a 40+/−4 mm inside diameter. The ball is best held in position, ready for dropping, with a magnetic field applied to the ball by a permanent magnet 306 through a barrier 307 formed of a non-magnetic material. The ball must be released so that it falls without rotation, and this can be assured by providing a ball shaped recess in the barrier 307 such as shown.

The tube 304 is centered over a base plate 308 of 6061-T6 aluminum, 4"×4" square by 0.25" thick. This represents a modification of ASTM International standard, Designation: D 3574-05 (Test H), which does not specify a particular support for the specimen, and instead specifies a sufficient thickness of specimen that the details of the structure supporting the specimen would not be relevant.

A square test specimen S is cut from a larger piece of the material, so that it has dimensions of 100 mm on a side. The test specimen is centrally (i.e., at the intersection with the cylindrical axis "L") disposed on the surface S of the base plate 308.

With the specimen placed centrally on the plate 308 and the ball placed centrally on the specimen, the top of the ball establishes a "zero rebound" height. The magnet or other device 306 is arranged to drop the ball 302 a distance "$D_{31}$" of 500 mm from the zero rebound height. Since the ball is about 16 mm in diameter, the top of the ball at the drop height is 516 mm above the upper surface of the plate 308.

A scale is provided on or in the tube 304 as follows: Every 5% of the drop height, starting at the "zero rebound" height, a full circle (a 360 degree arc) is inscribed, and every 1% a 120 arc is inscribed. It is important to provide and utilize the full circles to eliminate parallax error.

Results for 3 specimens are obtained and averaged.

Test D

Figure 8:
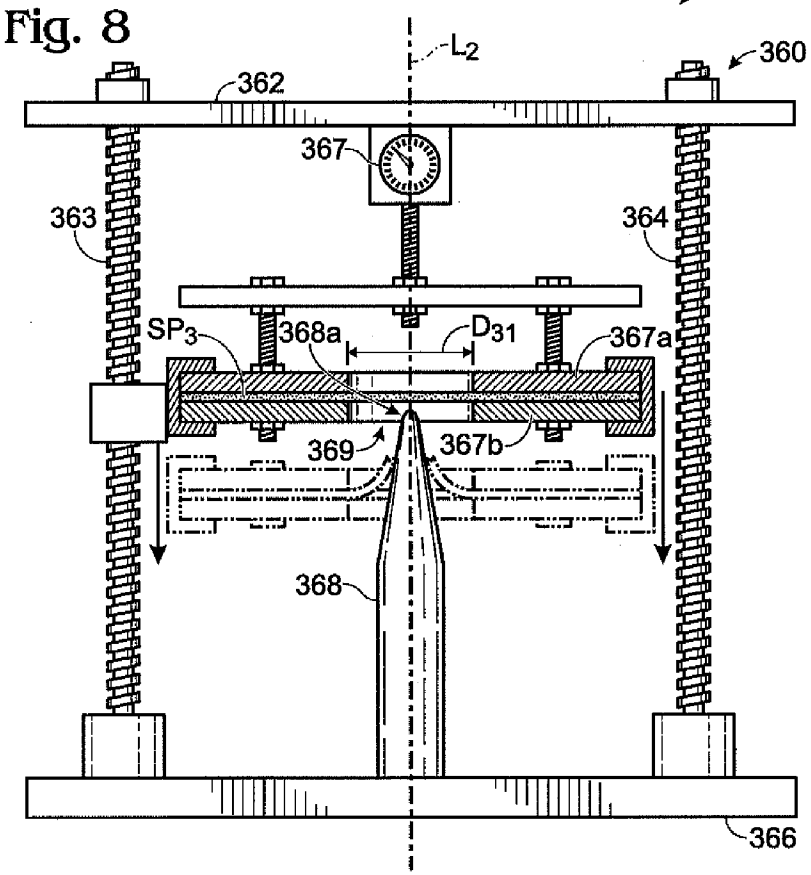
FIG. 8 is an elevation view of an apparatus for measuring puncture resistance of the material of which the creeper of FIG. 1 is formed according to a Test D as defined herein.

Puncture resistance of the material 12 is tested with the apparatus 350 of FIG. 8. The apparatus 350 includes a standard compression testing apparatus 360 such as the Instron® Model 5900 Testing System, sold by the Instron Company of Norwood Mass., USA. The apparatus 360 has a horizontal, upper cross-member 362 that is driven by parallel screws 363, 364 to move upwardly and downwardly relative to a fixed horizontal, lower cross-member 366 at a programmable, steady rate of speed. A load cell 367 is provided with the apparatus, attached to the upper cross-member 362 on a central axis "$L_2$."

A vertically oriented, elongate puncturing element 368 is supported by the lower cross-member. The puncturing element has a tip portion 368*a* that has substantially the same shape as the tapering tip at the end of a flat-blade screw-driver, the tip portion 368*a* having a width (corresponding to the length of the slot in a slot screw-head) of 7.92+/−2.5 mm and a thickness (corresponding to the width of the slot of the slot screw-head) of 0.8+/−0.1 mm at the extreme tip. The edges of the tip portion 368*a* are to be rounded to a 0.25 mm radius.

A specimen clamp 370 is attached to the load cell 367 of the apparatus 350. The specimen clamp is for clamping a specimen $SP_3$ of the material. As shown, the specimen clamp is adapted to mechanically support the specimen symmetrically about the axis $L_2$.

The specimen clamp comprises two circular clamping portions, an upper clamping portion 367*a* and a lower clamping portion 367*b*. The two clamping portions define a circular aperture 369 that is centrally disposed about the axis $L_3$, having a diameter "$D_{31}$" of 44.4+/−0.05 mm. The specimen $SP_3$ is to be clamped between the two clamping portions.

The specimen $SP_3$ is cut from a larger piece of the material so that it is circular, with a diameter that is at least 12.7 mm greater than the diameter $D_{31}$. The specimen is to be centered between the clamping portions, relative to the axis $L_2$.

The specimen may have a matrix of "warp" and "fill" threads, the warp threads running perpendicular to the fill threads. In that case, the elongate dimension of the puncturing tip portion 368 in the azimuthal plane is to be oriented at an angle of 45 degrees relative to the warp and fill directions. More generally, if the specimen defines a matrix of components defining an angle therebetween which could be other than 90 degrees, the azimuthal orientation of the puncturing tip portion 368 relative to the matrix is to be ½ that angle.

The cross-member 362 is moved downwardly toward the puncturing element at a rate of 5.0+/−0.2 mm/sec until the specimen contacts the puncturing element and, eventually, is punctured by the puncturing element. The puncture resistance measure for the specimen is the maximum force measured by the load cell 367, which will be the force at the instant prior to puncture.

The tests should be conducted with the specimen at room temperature, between 20 and 25 degrees C.

Results for 3 specimens are obtained and averaged.

Test E

Figure 10:
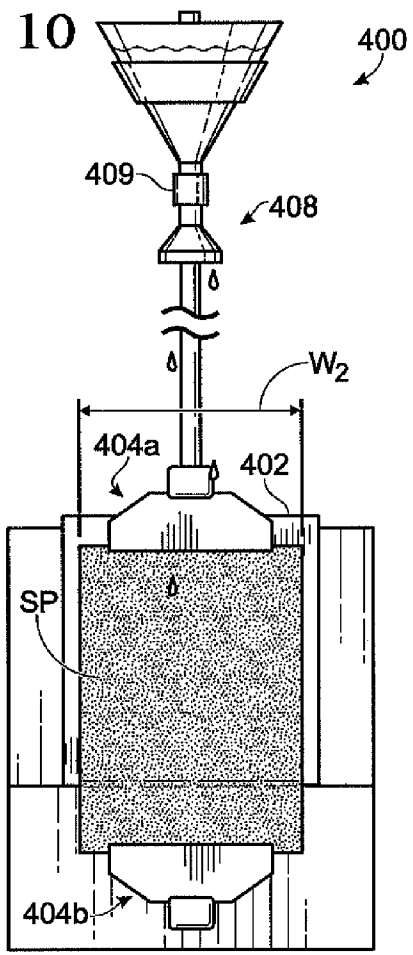
FIG. 10 is a front elevation of a steel plate portion of the apparatus of FIG. 8 showing a specimen attached to the apparatus and held in position by use of two spring clamps.
Figure 9:
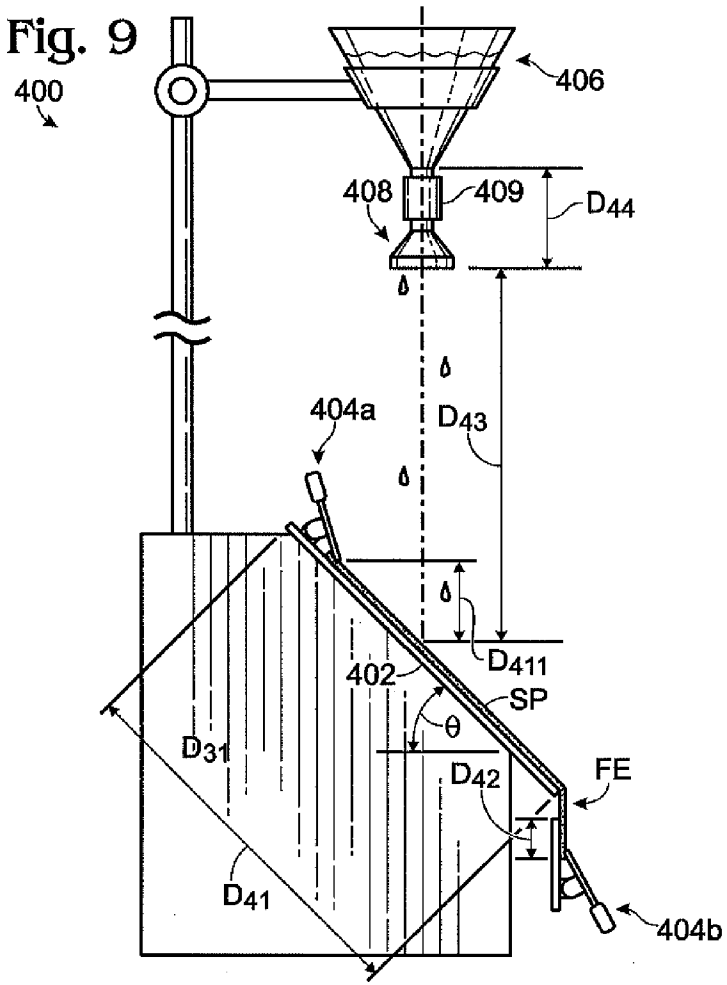
FIG. 9 is a side elevation view of an apparatus for measuring a water penetration of the material of which the creeper of FIG. 1 is formed according to Test E as defined herein.
Figure 11:
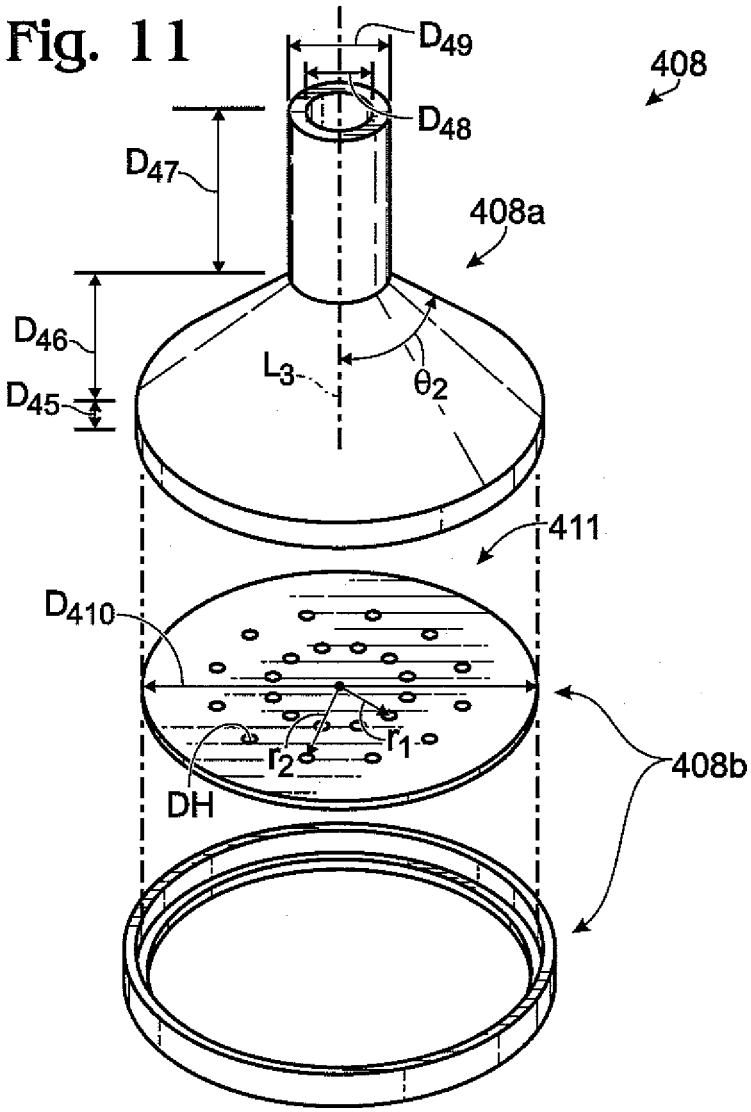
FIG. 11 is an isometric, exploded view of a spray head for the apparatus of FIG. 9.
Figure 13:
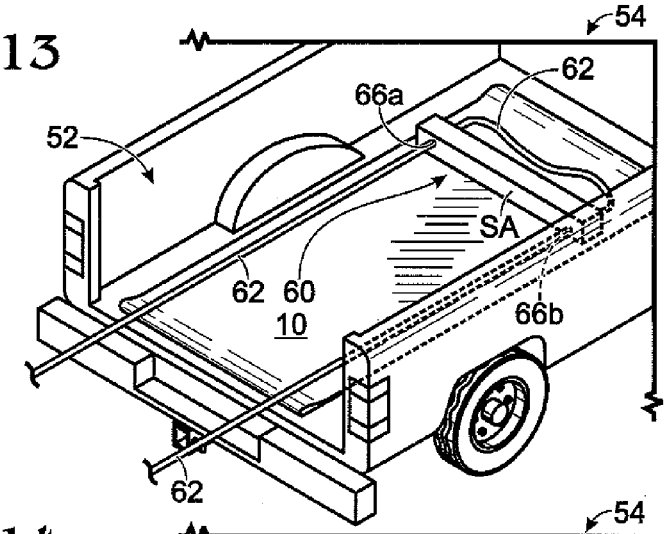
FIG. 13 is an isometric view of a creeper according to the invention in the bed of a pick-up truck, along with a harness according to the invention.

The resistance of the material 12 to water penetration according to Test E is measured with the apparatus 400 shown in FIGS. 9-11. The apparatus may be obtained from AATCC, P.O. Box 12215, Research Triangle Park N.C. 27709.

Referring to FIG. 9, the apparatus includes a steel plate 402 inclined at an angle of 45 degrees relative to the horizontal. The plate 402 is for supporting a rectangular test specimen S cut from a larger piece of the material so that it has dimensions of 178 mm (width) by 330 mm (length), with the warp (the thread direction) coincides with the length dimension.

The specimen S is held in place on the plate 402 with a combination of spring clips 404*a*, 404*b*, one (404*a*) for clipping the specimen to the plate and one (404*b*) for clipping to a free end "FE" of the specimen that hangs down below the end of the steel plate.

The spring clips 404*a* and 404*b* are 152 mm+/−10 mm in width, and the clip 404*b* in particular at the free end should provide a weight of 0.4356 kg for drawing the specimen taut against the steel plate.

With reference to FIG. 10, the specimen is laterally centered on the plate 402.

Turning back to FIG. 9, a 152 mm (inner diameter) glass laboratory funnel 406 is held above the plate 402 and clamped specimen.

Attached to the neck portion 402*b* of the funnel 406 is a "spray head" 408 by use of a 9.5 mm (inner diameter) rubber tube 409.

FIG. 11 shows the spray head 408 in detail. It has a head portion 408*a* and a spray cap portion 408*b*. The head portion 408*a* is formed of bronze, and the spray cap portion has a spray disc 411 which is 0.8 mm thick and which is formed of brass.

The disc 411 has 24 drip holes "DH," each having a diameter 0.99 mm, arranged radially symmetrically as shown on two concentric circles, radius $r_1$ and $r_2$ (measured from the center of the disc to the center of the hole) respectively.

Important dimensions for the apparatus are as follows. Unless otherwise indicated, the tolerances are +/−1 mm.

W=178 mm
$D_{41}$=305 mm
$D_{42}$=57 mm
$D_{43}$=0.60 m+/−0.01 m
$D_{44}$=76 mm
$D_{411}$=63 mm
$\theta_1$=45+/−1 degree
$D_{45}$=5.5 mm+/−0.1 mm
$D_{46}$=20 mm
$D_{47}$=26.2 mm+/−0.1 mm
$D_{48}$=9.5 mm+/−0.1 mm
$D_{49}$=12.7 mm+/−0.1 mm
$\theta_2$=48+/−1 degree, measured from vertically oriented centerline "$L_3$"
$D_{410}$=46 mm
$r_2$=9.15 mm+/−0.1 mm
$r_1$=16.25 mm+/−0.1 mm Also required for this test is a blotting paper (152 mm×230 mm) that may also be obtained from the above named source. The blotting paper is more generally specified as common blotting paper—100% cotton, white, smooth surface, 0.10"+/−0.01" thickness.

The specimen and blotting paper should be conditioned at least 4 hours at 27+/−1 degrees Celsius and 65+/−2% relative humidity before testing.

The blotting paper is then weighed to the nearest 0.1 g and inserted between the steel plate and the specimen.

500+/−10 ml of distilled, de-ionized water at a temperature of 27+/−1 degree Celsius is poured into the funnel 406. The water should be poured to avoid imparting a swirling motion of the water in the funnel. This can be achieved by providing a small blade fixed to the inside of the funnel extending in a vertical plane. The water will pass through the drip holes DH of the spray head and drip onto the specimen. At the completion of this dripping period, the blotting paper is quickly removed and re-weighed to the nearest 0.1 gram to determine the amount of water passed through the specimen.

Results for 3 specimens are obtained and averaged.

Test F

The oil repellancy grade of the material 12 according to Test F is measured by applying different oils of varying surface tensions or "grades" to the surface of the material and determining the highest grade which does not wet the surface. Test specimens cut from a larger piece of the material are 20 cm wide and between 20 and 40 cm long. The test specimens should be conditioned for a minimum of 4 hours at 21+/−1 degree Celsius and 65+/−2% relative humidity before testing.

The test oils and their associated grades and surface tensions (dynes/cm at 25 degrees Celsius) are as follows:

1 Kaydol 31.5

2 65/35 combination Kaydol/n-hexadecene by volume 3 n-hexadecene 27.3

The oils are applied to the specimen in droplet form, starting with the lowest grade (1) and progressing with higher grades until a grade is reached which results in "obvious wetting or wicking" of the oil by the material. The oil repellancy grade is the immediately preceding grade, i.e., the highest grade that does not result in "obvious wetting or wicking" of the oil by the material. It may be noted that the ASTM standard specifies higher grade oils (grades 4-8) than those shown here, but what is shown here is sufficient for purposes herein.

The test procedure is specifically as follows: Five drops of each oil should be applied to the material at five different locations, spaced about 4.0 cm apart. Each drop size is about 5 mm diameter (or 0.05 ml volume). It is important to apply the drops without touching the material with the dropper tip. Observe whether a given drop wets the surface or not 30+/−2 seconds after application of the drop.

It is to be understood that, while a specific mechanic's creeper has been shown and described as preferred, other configurations could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A creeper, comprising a sheet-like material in a tubular configuration, wherein the material is formed of one or more layers joined to one another, the creeper having an inner side defining a coefficient of friction of not more than about 0.35, the material in bulk having a flexural rigidity according to Test A of between about 2,000 and 500,000 mg-cm, and a crease recovery according to Test B of more than about 100 degrees.

2. The creeper of claim 1, wherein the material has a water penetration according to Test E of 5 grams or less.

3. The creeper of claim 2, wherein the material has an oil repellency grade, according to Test F of at least 2.

4. The creeper of claim 1, wherein the material has an oil repellency grade, according to Test F of at least 2.

5. The creeper of claim 4, wherein the material in bulk has a resilience according to Test C of between about 5 and 40%.

6. The creeper of claim 3, wherein the material in bulk has a resilience according to Test C of between about 5 and 40%.

7. The creeper of claim 2, wherein the material in bulk has a resilience according to Test C of between about 5 and 40%.

8. The creeper of claim 1, wherein the material in bulk has a resilience according to Test C of between about 5 and 40%.

9. The creeper of claim 8, wherein the material in bulk has a puncture resistance according to Test D of at least 10 pounds.

10. The creeper of claim 7, wherein, the material in bulk has a puncture resistance according to Test D of at least 10 pounds.

11. The creeper of claim 6, wherein the material in bulk has a puncture resistance according to Test D of at least 10 pounds.

12. The creeper of claim 5, wherein the material in bulk has a puncture resistance according to Test D of at least 10 pounds.

13. The creeper of claim 4, wherein the material in bulk has a puncture resistance according to Test D of at least 10 pounds.

14. The creeper of claim 3, wherein the material in bulk has a puncture resistance according to Test D of at least 10 pounds.

15. The creeper of claim 2, wherein the material in bulk has a puncture resistance according to Test D of at least 10 pounds.

16. The creeper of claim 1, wherein the material in bulk has a puncture resistance according to Test D of at least 10 pounds.

17. A creeper, comprising a sheet-like material in a tubular configuration, wherein the material is formed of one or more layers joined to one another, the creeper having an inner side defining a coefficient of friction of not more than about 0.35, the material in bulk having a flexural rigidity according to Test A of between about 2,000 and 500,000 mg-cm, and a puncture resistance according to Test D of at least 10 pounds.

18. The creeper of claim 17, wherein the material in bulk has a resilience according to Test C of between about 5 and 40%.

19. A creeper, comprising a sheet-like material in a tubular configuration, wherein the material is formed of one or more layers joined to one another, the creeper having an inner side defining a coefficient of friction of not more than about 0.35, the material in bulk having a crease recovery according to Test B of more than about 100 degrees, and a puncture resistance according to Test D of at least 10 pounds.

20. The creeper of claim 19, wherein the material in bulk has a resilience according to Test C of between about 5 and 40%.

* * * * *